United States Patent [19]

Bitko

[11] 4,099,040

[45] Jul. 4, 1978

[54] MERCURY TYPE TILT SWITCH

[75] Inventor: Sheldon S. Bitko, East Brunswick, N.J.

[73] Assignee: Fifth Dimension, Inc., Princeton, N.J.

[21] Appl. No.: 672,050

[22] Filed: Mar. 30, 1976

[51] Int. Cl.[2] ..... H01H 29/20

[52] U.S. Cl. ..... 200/220; 200/61.47

[58] Field of Search ..... 200/220, 223, 224, 225, 200/226, 235, 236, 61.47

[56] References Cited

U.S. PATENT DOCUMENTS

| | | | |
|---|---|---|---|
| 1,107,245 | 8/1914 | Bard | 200/226 |
| 1,940,028 | 12/1933 | Staley | 200/222 |
| 3,011,040 | 11/1961 | Remer et al. | 200/224 |
| 3,351,726 | 11/1967 | Cook | 200/226 X |
| 3,599,745 | 8/1971 | Hughes | 200/61.47 |
| 3,646,490 | 2/1972 | Bitko | 200/234 |
| 3,855,784 | 12/1974 | Foellner | 58/50 R |

*Primary Examiner*—Harold Tudor
*Attorney, Agent, or Firm*—Burns, Doane, Swecker & Mathis

[57] ABSTRACT

A tilt switch of the mercury type wherein at least one electrode extends into the switch chamber containing a mercury-like globule which is movable back and forth between a first position resulting in the switch being in a state of conductivity or non-conductivity when it is oriented within a first solid angle and the opposite state when it is oriented outside that solid angle. The chamber is of at least generally dry wall construction and may be of small size for use in activating a LED or LCD display of a battery-powered wristwatch.

6 Claims, 32 Drawing Figures

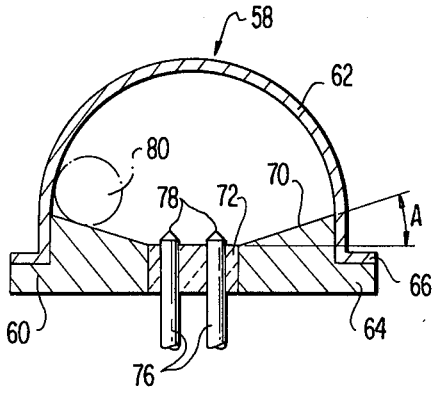
FIG. 7
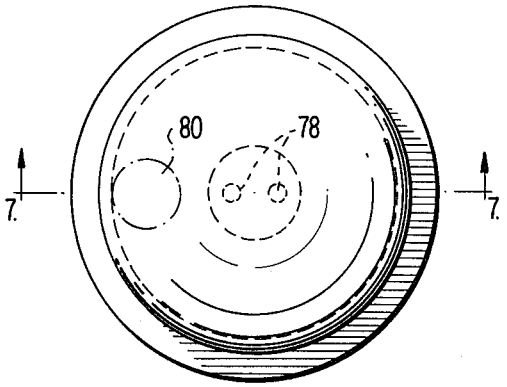
FIG. 8
FIG. 9
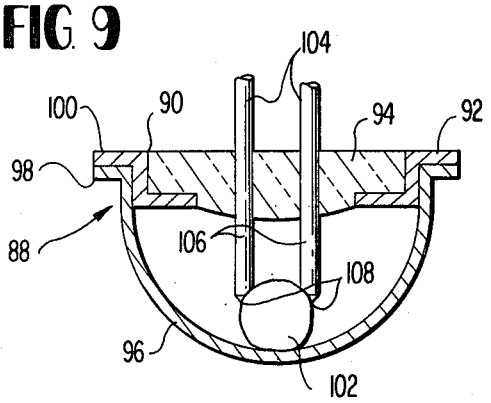
FIG. 10
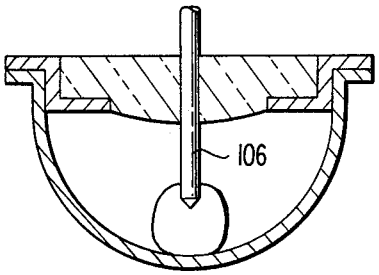
FIG. 11
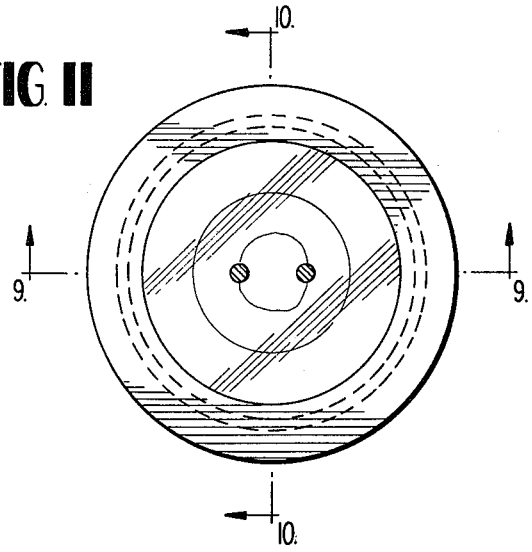
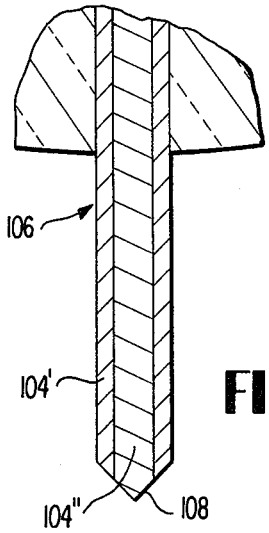
FIG. 12

FIG. 13
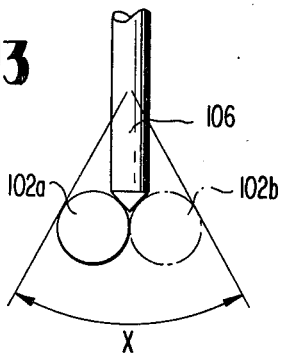
FIG. 13b
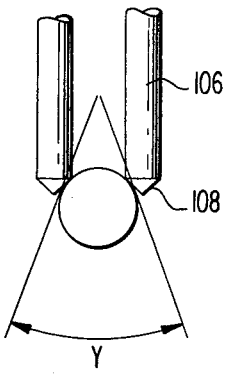
FIG. 13a
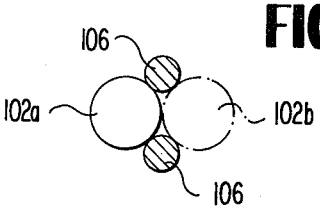
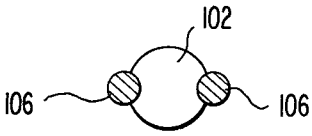
FIG. 13c
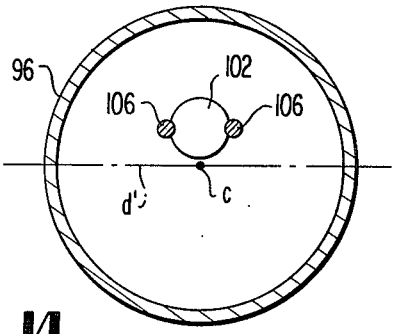
FIG. 14
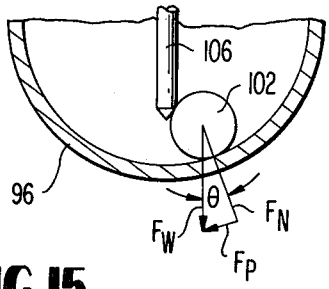
FIG. 15
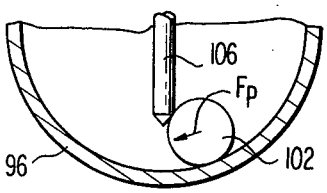
FIG. 15a
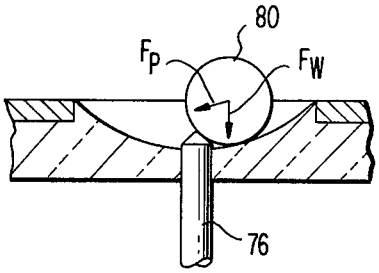
FIG. 15b FIG. 16
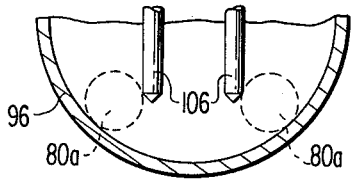
FIG. 16a
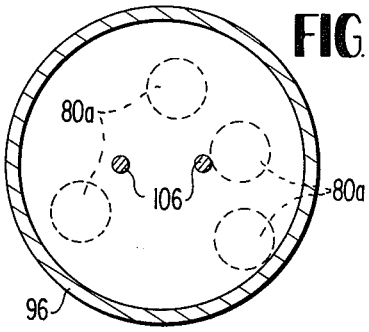
FIG. 17
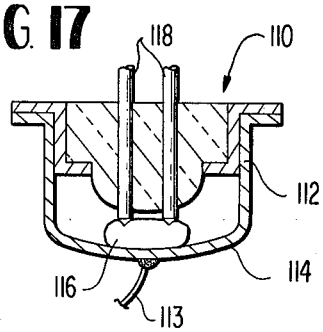
FIG. 17a
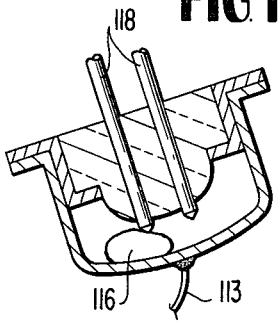
FIG. 17b
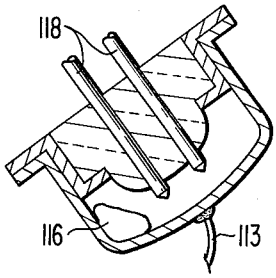
FIG. 19
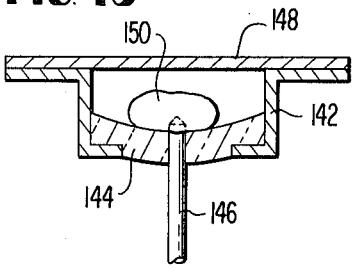
FIG. 18
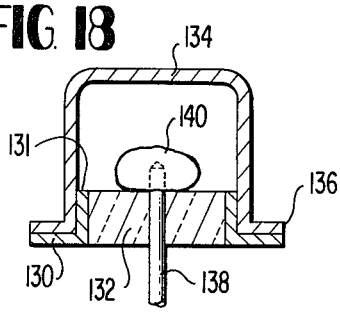
FIG. 18a
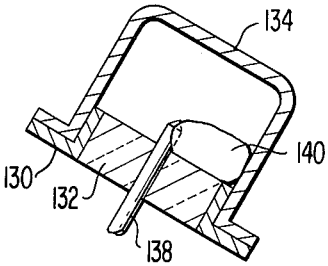
FIG. 20
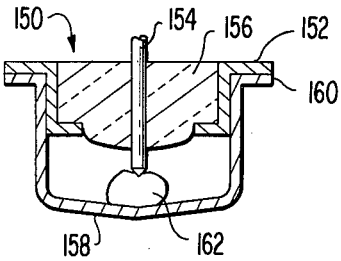
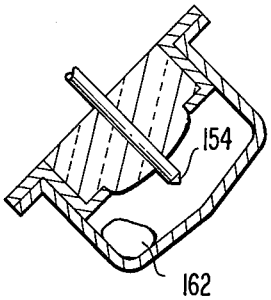
FIG. 20a

MERCURY TYPE TILT SWITCH

BACKGROUND OF THE INVENTION

There has recently been developed a battery operated wristwatch of solid state components programmed to continuously keep the time. However, the watch uses an electronic display which, to conserve power, is operated only upon signal rather than continuously. The display may be of the light emitting diode (LED) type or liquid crystal display (LCD) type and has been most frequently operated on demand as a result of manually closing a switch.

There have also been several proposals for using demand switches which do not require depression or actuation by the wearer's free hand.

As one example, U.S. Pat. No. 3,871,170 discloses use of a switch actuated in response to inertia resulting from a deliberate arm movement to move a conductive ball of mercury rapidly between two positions to close two sets of contacts in rapid succession. This type of switch requires a quick unnatural motion of the arm which may frequently be inconvenient and uncomfortable to the wearer.

In U.S. Pat. No. 3,841,080 there is disclosed a tilt sensitive switch wherein an asymmetrical balanced disc is used to actuate electrical contacts for causing display on demand. U.S. Pat. No. 3,921,385 uses a round conductor or ball that is actuated in a cavity by gravity to close on demand a switch actuating the wristwatch display. The mechanical switches of these latter two patents require substantial space and may be subject to undue wear as well as undesirable noise in operation. Both of these patents apparently recognize the superior features that mercury tilt switches would offer as demand switches for wristwatches. However, both patents conclude that known merucy tilt switches also present problems which lead the patentees to reject them for such use.

In my copending U.S. pat. application Ser. No. 600,922, for "Mercury Tilt Switch", filed July 31, 1975, I have disclosed a tilt switch suitable for actuating an LED display or the like for a battery-operated wristwatch. The switch of that application is of a wet construction, employing merucy-wettable surfaces.

My present invention is directrd to a new and improved mercury-type tilt switch that is particularly suitable, both as to size and operating characteristics, as a demand switch for a battery-operated wristwatch and to a wristwatch utilizing such switch.

An example of a prior art mercury tilt switch is disclosed in U.S. Pat. No. 3,599,745, issued to Benjamin F. Hughes. This switch comprises a housing having a globule of mercury therein, which housing is attached to a tiltable vehicle. The housing is of insulating material with a hemispherical top and a base at the center of which an elevated table is formed with a concave seat into which a pair of electrical contacts extend. The switch can be manipulated to locate the mercury globule on the concave seat to bridge the contacts. If the switch is tilted more than a predetermined extent from the horizontal, as by tilting of the vehicle on which it is mounted, the globule is displaced from the seat by gravity and falls into an annular groove surrounding the seat. The table on which the seat is located being raised and having concave ends, mere return of the switch in the reverse path to its opening movement through the angle of tilt, as by the vehicle being returned to a level position, will not cause the globule to return to the seat. Instead, the switch must be manipulated, as by more or less inverting it, to center the globule over the seat and thus reset it to bridge the contacts.

Another tilt type switch is disclosed in U.S. Pat. No. 3,351,726 issued to Leonard W. Cook. This switch includes a hollow gas-tight cylindrical metal housing with a terminal rod extending in insulated relationship into the housing through a member of inorganic insulating material at an end of the cylinder. A quantity of liquid metal of high surface tension, such as pure mercury, is disposed in the casing. The mercury is of a size large enough to bridge the terminal rod and the side wall of the housing when the switch is in an upright position and to separate from the terminal rod and engage only the housing when tilted at what the drawing reveals as a very large angle from the upright position.

SUMMARY OF THE INVENTION

In accordance with the present invention, there is provided a dry wall tilt switch of the mercury type which can be made of very small size particularly suited for uses such as controlling an electrooptical display for a wristwatch. It is a general object of the invention to provide a novel switch suitable for mounting in a wristwatch to actuate the switch with precision over a predetermined solid angle and to operate the display when the watch is oriented in the range where reading the watch is desired without any significant tendency toward accidentally causing switch actuation.

To minimize its size, the switch is preferably provided with a casing or enclosure of metal and the metal preferably has at least an inner surface of mercury-unwettable composition. While a globule of mercury is generally referred to in the application, it is known that addition of small amounts of other elements, such as caesium and potassium, reduces surface tension of mercury and affects the shape of a globule, that is, makes it larger in diameter and shallower. The term "mercury" as used herein is to be considered to include mercury with an additive or additives to reduce surface tension. Other fluids than mercury which are electrically conductive and have similar high surface tension characteristics such as will result in the globule shapes desired for operation as hereinafter described might be substituted in certain cases.

Other objects and advantages of the present invention will become apparent from the subsequent detailed description in conjunction with the accompanying drawings.

DESCRIPTION OF THE DRAWINGS

FIG. 7 is a sectional view taken along line 7—7 of FIG. 8 of a modified form of switch according to my invention;

FIG. 8 is a plan view of the switch of FIG. 7;

FIG. 9 is a sectional view taken along the line 9—9 of FIG. 11 of another modified form of switch in accordance with the invention;

FIG. 10 is a sectional view taken along the line 10—10 of FIG. 11;

FIG. 11 is a top plan view of the switch of FIG. 9;

FIG. 12 is a partial sectional view on an enlarged scale of a preferred form of electrode structure for use in the switch of FIG. 9;

FIGS. 13, 13*a*, 13*b* and 13*c* are diagrammatic views for comparison of the angle of closure of a two-electrode tilt switch of my invention in two perpendicular directions of tilt;

FIG. 14 is a diagrammatic view showing a modified positioning of the electrodes of a switch such as that of FIGS. 1, 7 and 9;

FIGS. 15, 15*a* and 15*b* are diagrammatic views illustrative of the effect of the force due to the weight of the globule of mercury in tilt switches of the type illustrated in the preceding figures;

FIGS. 16 and 16*a* are diagrammatic views illustrative of the operation of a two-electrode switch of the invention in response to random movements.

FIGS. 17, 17*a* and 17*b* are sectional views of another modified form of switch in accordance with the invention shown in three different positions;

FIGS. 18 and 18*a* are sectional views of still another modified switch in accordance with the invention showing two different positions thereof;

FIG. 19 is a sectionsl view of a switch representing a modified form of the switch of FIGS. 17 and 17*a;* and FIGS. 20 and 20*a* are sectional views of yet another modified form of switch according to the invention in two different positions.

DETAILED DESCRIPTION

Figure 1:
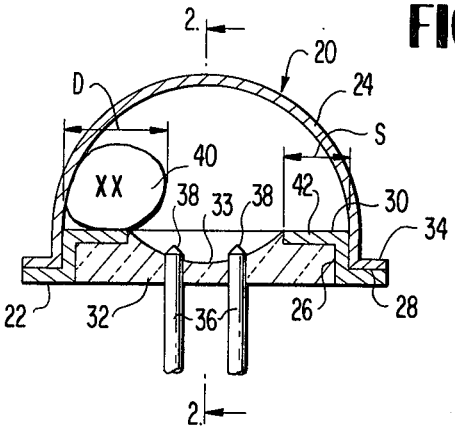
FIG. 1 is a sectional view taken along the line 1—1 of FIG. 3 of a preferred form of switch in accordance with my invention.

Referring to FIGS. 1 through 4, a switch 20 includes a casing or enclosure made up of a header 22 and a cap 24. The header 22 includes a peripheral portion of metal comprising a cylindrical ring portion 26, an outwardly extending circular flange 28 and an inwardly extending flange 30. Centrally disposed within the peripheral portion of the header in bonded, sealed relationship therewith is a central seal portion 32 which is preferably of glass but may be of a ceramic or plastic insulating material having similar properties. The dome shaped cap 24 is preferably also of metal and is provided with a flange 34 welded to flange 28 of the header to seal the enclosure. A pair of spaced electrodes 36 extend through the glass seal 32 in sealed relationship thereto with tips 38 thereof extending into the sealed enclosure. A globule 40 of liquid conductive material having high surface tension, preferably mercury or mercury having a small amount of one or more materials therein to lower its surface tension (e.g., casesium or potassium), is disposed in the enclosure.

Figure 1A:
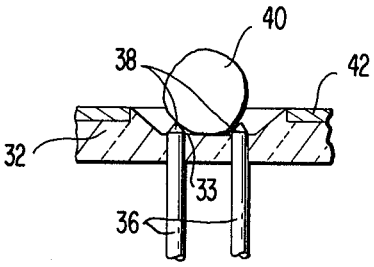
FIG. 1*a* is a partial sectional view corresponding to FIG. 1 but showing the switch in closed condition.

The upper surfce of the glass seal 32 of the header is dished to provide a depression 33 adapted to seat the globule in the upright position of the switch with the header substantially horizontal. The depression 33 may be provided in the form of a wall sloping to a lower most central concavity as illustrated in FIG. 1 or in the form of walls tapering to a central flat as shown in FIG. 1*a*. The tips 38 of the electrodes 36 may be more or less symmetrically disposed about the center of the seal 32. The spacing of the electrode tips 38 and the size of the globule 40 are so related that when the globule is seated the electrode tips are bridged by the globule to close an electric circuit therebetween.

As will be appreciated the upper surface of the flange 30 of the header forms, with the switch in upright position, a generally horizontal shelf 42 about the glass seal 32, on which shelf the globule may rest when the switch is oriented in positions where actuation is not desired. Referring particularly to FIG. 1, in the orientation there shown, the radial extent S of the shelf is more than one-half the diameter D of the globule.

Figure 4:
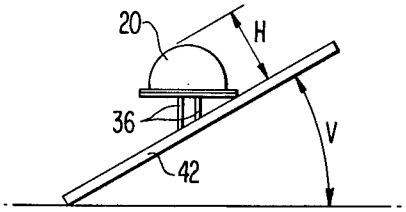
FIG. 4 and 4*a* are diagrammatic views on different scales representing a switch according to my invention mounted on a printed circuit board constituting part of a solid state wristwatch.
Figure 4A:
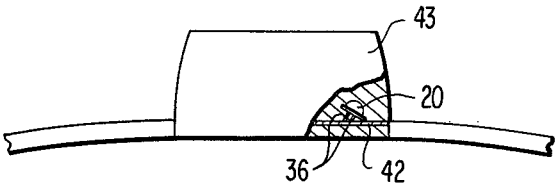

In use in a wristwatch, the switch will ordinarily be disposed at an angle to the watch face such that the switch is in horizontal position when the wristwatch is at substantially the center of the solid angle of orientation in which it is usually viewed by a wearer. FIGS. 4 and 4*a* show a manner in which the switch may be secured to a printed circuit board 42 of a solid state wristwatch 43 by means of the electrodes 36 of the switch, although other supporting arrangements may be used. In FIG. 4, the angle V represents substantially the center of the viewing angle desired in which the plane of the paper may, for example, represent the plane perpendicular to the face of the watch passing through the 6 and 12 o'clock positions. The switch may also be tilted to a preferred angle in the plane perpendicular thereto. Different angles of operation of the switch may be desired in the two perpendicular planes. For example, one may desire an operating or viewing angle of about 0° to 50° in one plane and about 10° to 20° in the other. The precise manner of mounting and orienting the switch to provide the desired angular operating characteristics will be apparent to one skilled in the art.

Figure 2:
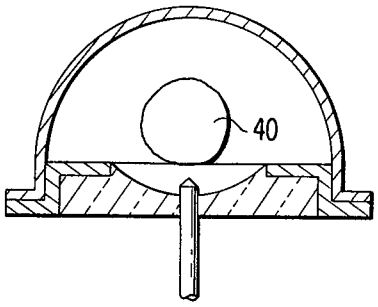
FIG. 2 is a sectional view of the switch taken along the line 2—2 of FIG. 3.
Figure 3:
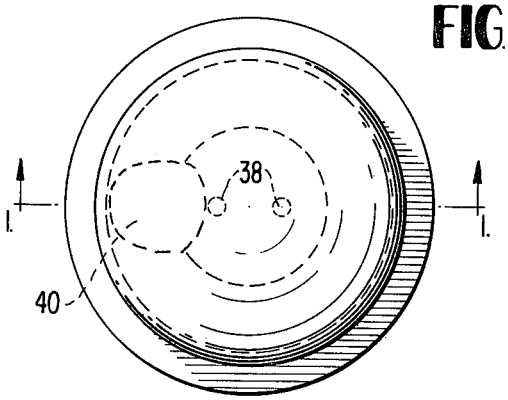
FIG. 3 is a top plan view of the switch of FIG. 1.

When a switch in accordance with FIGS. 1 to 3 is installed in a wristwatch as described, the arm of the wearer will ordinarily be in positions which either result in the globule 40 being in engagement with the surface 42 of the shelf and the interior of the wall surface of the cap 24 or in which it rests solely on that wall surface. In either event, the globule will be lower than the depression or seat 33 as the wearer moves his arm to bring the wristwatch to the usual viewing position tilted somewhat to the horizontal. As the movement progresses, the globule will ordinarily reach a position as shown in FIG. 1 where slightly more than half its weight is outside the inner edge of the shelf. Further tilting of the watch through the horizontal position of the switch will move the center of the globule so that most of its weight shifts to inside the edge of the shelf and cause the globule to move into the depression 33 to bridge the electrodes 36. The latter position is shown in FIG. 1*a*. As will be appreciated, even where the radial extent S of the shelf is less than one-half the diameter 10 of the globule, appropriate dimensional and mounting parameters may be selected such that the globule moves into and out of the depression 33 when the switch is in the desired orientations.

In this switch of FIGS. 1 to 3, the controlling parameters appropriate for movement of the globule into and out of the depression 33 are the width S of the shelf, the diameter D of the globule, and the depth of and slope to the depression. The critical angle for seating of the globule in the depression 33 is the point where the weights of the portion of the globule on each side of the inner rim are equal. The depression depth and slope enters into consideration in connection with movement of the globule out of the depression 33, and by appropriate selection of these parameters, opening characteristics of the switch can be optimized. Thus the critical angle may be selected in constructing the switch by relating the dimensions S and D and the depression depth and slope. Additionally the spacing of the terminals and depression diameter will play a part in optimizing operating characteristics. Of course, the diameter of the globule is a function of weight or quantity of the mercury in the globule. Therefore, switches according to FIGS. 1 to 3 having the same mechanical dimensions in other respects may be provided with different critical operating angles within a desired range by varying only the amount of mercury in the globule provided.

It is significant that the switch can be opened by a movement of the arm carrying the wristwatch that is the reverse of the movement of the arm to reading position. As such, no unusual or unnatural movement of the arm or wristwatch is necessary to operate the switch in either direction.

While it is contemplated that a switch similar to that of FIGS. 1 to 3 may be made with the header 22 and cap 24 of glass, ceramic materials or plastics, such materials result in a number of disadvantages over my preferred construction, particularly for a switch of very small dimensions that is required to provide uniform and accurate performance. I therefore prefer to construct the header and cap of my switch of metal as already stated. Further, it is particularly advantageous in most circumstances that the metal is of a composition, or has an inner surface of a composition, that is not mercury-wettable and not subject to becoming mercury-wettable in spots or areas with continued use. The interior of the switch is sealed free of oxygen which would tend to cause degradation. Also, an inert gas may be provided in the switch if desired. Since the header 22 and cap 24 are welded together at their flanges, it is also important that the metal have a proper electrical resistance to permit satisfactory welding at that location.

In the past a known chromium-containing alloy on which a chromium oxide is produced by heating in wet hydrogen to form a suitable layer of ionically combined oxygen has been used for contacts of a nontilt-type mercury switch. I have found that this material provides good results when used as the metal header and cap, since the resulting oxide will not "outgas", that is, it will not permit release of oxygen into the interior of the switch. While a number of chromium-bearing materials can be used, those with a sufficiently small amount of chromium as to result in an oxide having an electrical resistance that can be easily overcome during welding are preferred. My preference for the header and cap material is Carpenter 42-6 alloy, also known as Sylvania #4, which material contains 42% nickel, 6% chromium and the remainder iron. That material is preferably oxidized as discussed above to avoid "outgassing" problems that occur in cases where some nickel-cobalt-iron alloys having an oxide formed in oxygen rather than in wet hydrogen are used. The material is also highly suitable as the glass sealing alloy for sealing the center portion 32 in the header. As an option, the interior surfaces of the metal header and cap may be clad with a metal such as tantalum to enhance its nonwetting characteristics.

The glass surface of the center 32 of the header is ordinarily naturally mercury-unwettable, as is preferred.

Since the switch is to be operable at low voltage and low current, it is desirable that there be low resistance contact between the mercury globule 40 and the tip portions 38 of the electrodes as will be attained when the tips are mercury-wettable and glass-unwettable.

Figure 5:
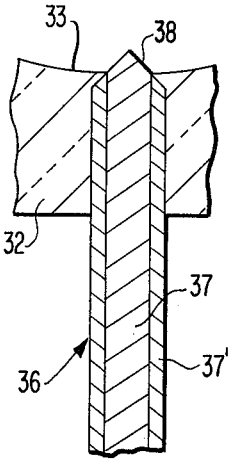
FIG. 5 is a partial sectional view on an enlarged scale of a preferred form of electrode structure in place in the switch of FIG. 1.

A preferred electrode construction is shown in FIG. 5. The electrode 36 includes a central core 37 covered by a sheath or jacket portion 37'. The core is preferably of a nickel-copper alloy which is mercury wettable but not glass wettable. It is preferably of small diameter, as from 0.004 to 0.005 inches. The jacket is preferably of the previously mentioned Carpenter 42-6 alloy, also known as Sylvania #4, and may be oxidized as described in connection with the header and cap construction. Being glass-wettable the latter material provides good bonding between the electrode sheath and the glass. The tips 38 are preferably pointed as shown and in the preferred construction only the mercury-wettable core portion of the tip extends above the glass surface. It is preferred that this extending portion be maintained as small as possible to avoid undue impedance to desired movement of the mercury. Tip protrusions of 0.004 inches or less with a diameter of 0.004 inches or less are preferred. Although the tips make good electrical contact with the mercury globule, their small size prevents them from providing significant surface tension adherence to the globule such as might cause the mercury to string out during opening of the switch. Even if a slight tendency toward stringing out were to occur, it will not impair the operation of the two-electrode switch since complete disconnection of the globe is only necessary at one of the electrodes to interrupt the bridging between them.

Figure 6:
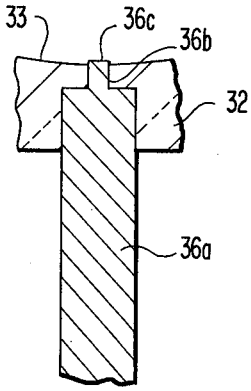
FIG. 6 is a partial sectional view on an enlarged scale of a modified form of electrode structure.

FIG. 6 shows an alternative electrode structure. In this arrangement, a solid wire electrode **36*a* of glass-wettable metal such as the Carpenter 42-6 alloy is reduced to a smaller diameter at its upper end 36*b* which preferably end substantially flush with the surface of the glass depression 33**.

The electrodes 36 may be made in the form of fine wires having a diameter of between 0.003 and 0.006 inches and ground substantially flush with the surface of the glass depression 33 at their upper ends. The ends may be electroplated at **36*c*** with a mercury-compatible metal so as to make the contact mercury-wettable.

The modification of my tilt switch shown at 58 in FIGS. 7 and 8 employs a header portion 60 and a domed cap 62 having outwardly extending peripheral flanges 64 and 66, respectively, welded together to form a sealed enclosure. The header 60 has an outer peripheral ring portion of metal with an upper surface 70 thereof sloping downwardly along a generally reverse conical configuration to a central portion 72 of glass or the like sealed to the peripheral portion. The central glass seal portion 72 has electrodes 76 extending therethrough with tips 78 thereof projecting into the concavity. The header 60 and cap 62 may be of the same metals as the corresponding parts in switch 20 of FIGS. 1 to 3. The electrodes and their tips may also be of the same construction as in that switch. The interior metal surfaces as well as the glass central portion are preferably mercury-unwettable.

In this switch of FIGS. 7 and 8, the controlling operating parameter is the angle A that the upper sloping surface 70 of the header 60 makes with the horizontal. A globule 80, of mercury or the like, is selected wih such size and surface tension that the restraining force which friction and surface tension exert is overcome by the opposing force due to its weight at the critical angle at which operation is required. The globule thus moves along the slope into the depression 72 for switch closure and out of the depression 72 for switch opening.

FIGS. 9 to 12 illustrate a two-electrode switch that basically involves an inversion of the parts of the switches previously described. This switch 88 includes a header 90 with a metal peripheral portion 92 and a glass central portion 94. An inverted dome-shaped metal cap 96 forms the bottom of the switch and includes a peripheral flange 98 welded to a corresponding flange 100 on the header to provide the sealed casing. A globule of mercury 102 disposed in the casing rests on the concave inner surface of the cap. Two spaced electrodes 104 pass down through the glass portion 94 of the header in sealed relationship thereto with portions 106 extending into the housing terminating in pointed tips 108. The materials for the switch 88 may be the same as for the switches previously described. The electrodes 104 preferably are mercury-unwettable along the portions 106 which extend into the cavity and the tips 108 are preferably mercury-wettable core portions as previously described.

FIGS. 9 and 10 show the switch in upright position with the header substantially horizontal. Through a predetermined solid angle of orientation about this position, the globule will bridge the electrodes 104 as before. It will be apparent that when the switch is tilted outside that angle, the globule will move to a position where it is out of contact with at least one of the electrodes and the switch is opened. The extent of the solid angle of switch closure will be determined by the size and configuration of the domed-shaped cap 96, (the cross-section of the cap in this and the other two forms may be elliptical or the like instead of circular, where desired), the spacing of the electrodes 104 and their tips 108, and the size of the globule of conductive material. As in the other switches described herein, the dry wall or mercury-unwettable characteristics of the interior surfaces of the enclosure avoids a tendency for the mercury of the globule to adhere to them due to surface tension and cause inconsistent performance of the switch.

The electrodes used here may be of cored construction similar to that already described and specifically is shown in FIG. 12. Thus an outer sheath 10 of mercury-unwettable material is left exposed along the part 106 of the electrode inside the casing. However, the tip 108 is pointed so that a core 104" of mercury wettable composition is exposed.

FIGS. 13, 13*a*, 13*b* and 13*c* illustrate how a two-electrode switch as disclosed in the three forms of my invention already described permits selection of different angles of acceptance or closure in the directions in line with the electrodes and in quadrature thereto. For convenience, only, elements are given the same numerical designations as in the last described embodiment. Thus the end portions of the electrodes are designated 106 and their tips 108. The conductive globule is 102. FIGS. 13 and 13*a* illustrate that in a plane normal to the line between the two contacts 106, the globule bridges the electrodes 106 between two positions 102*a* and 102*b* of the globule encompassing nearly twice its diameter. In the plane including the electrodes as illustrated in FIGS. 13*b* and 13*c*, movement of the globule only a slight distance from the central position will separate one of the electrodes from the globule, leaving an angle of closure or acceptance only slightly greater than the diameter of the globule. The spacing of the electrodes and the size of the globule are thus two parameters which may be varied to control this effect to provide the desired asymmetry in the solid angle of closure of the switches of the three embodiments already described.

It is further possible to vary the center of the solid angle of closure of the electrodes by spacing them off center relative to the upright or vertical axis of the switch. In FIG. 14, the center of the cap 96 is represented at *c* and the electrodes 106 are shown displaced on the same side of the diameter *d'* thereof to shift the center of the angle of closure in a direction perpendicular to that diameter.

FIGS. 15, 15*a*, and 15*b* illustrate that the weight of the globule acts differently in the first two switches with bottom electrodes than in the third switch with the downwardly extending electrodes. In FIG. 15, the globule 102 of the third form is shown as it moves along the surface of cap 96 between the two spaced electrodes 106 toward full contact with them. The full force due to the weight of the globule is represented by $F_w$ and the forces normal and parallel to the desired direction of globule movement by $F_N$ and $F_D$, respectively. The relationship of these forces is represented by $F_p = F_w \sin \theta$. Since $\theta$ is small, the force $F_P$ is very small. With the upper electrodes as also shown in FIG. 15*a*, a great percentage of the force $F_w$ does not act on the electrodes 106, which are above it, to aid in moving the globule between the two electrodes. In a switch as that of FIGS. 7 and 8 using the construction with the lower electrodes 76, however, FIG. 15*b* shows that a large part of the force $F_w$ does provide a force acting against the two electrodes to aid in moving the globule 80 through the zone of the electrodes when required. For this reason, the switch arrangement of FIG. 15*b* is preferred.

As will be appreciated, with the present invention there is minimal likelihood of the electrodes being accidentally closed during normal swinging of the arm carrying a wristwatch using the switch. FIGS. 16 and 16*a*, show various positions 80*a* that the globule 80 can assume in the cap 96 relative to the electrodes 106. It will be seen that in most positions it will take during swinging of the arm, the globule will impinge more or less directly against a single electrode 106 and be repulsed in its movement toward the center electrode-bridging position. Only on the rare ocassions when the swinging movement propels the globule along a line directly to bridging position, that is, a vertical direction as shown in FIG. 16*a*, will there be any significant change that the globule will pass between the electrodes and thus accidentally bridge them to cause false operation.

FIGS. 17, 17*a* and 17*b* illustrate a modification of the switch of FIGS. 9 to 12 with a pair of upper electrodes. In this form, the header 110 is welded to metal cap 112 which has a configuration providing what might be termed a circumferential corner portion 114. A globule 116 of mercury or like conductive material bridges the two electrodes, designated 118, when the switch is oriented in substantially upright position as shown in FIG. 16; and the switch may be connected to an external circuit in the same manner as the switches previously described. However, the cap 112 may have welded thereto a conductor 113 which serves as an external terminal in addition to electrodes 118 or in place of one of them. In the moderately tilted position of FIG. 17*a* the globule no longer bridges the two electrodes but it does bridge between one of them and the cap 112 whereby a circuit is connected between the electrode and conductor 113. Finally, the globule contacts the cap only in the more extremely tilted position of FIG. 17*b*, and the switch does not close any circuit.

In addition to the preferred forms of my invention using two electrodes as described above, certain switches may also be provided using one electrode extending into the enclosure with the switch housing itself forming the other switch contact.

FIGS. 18 and 18*a* illustrate two positions of one such dry wall switch. This switch includes a header portion 130 with metal peripheral portion 131 and a central portion of glass or like material 132. A metal cap portion 137 is welded to the header by complementary flanges at 136. A single electrode 138 extends through the center portion 132 into the switch enclosure. A globule 140 of mercury or the like is disposed in the enclosure. Preferably the interior of the enclosure is made merucy-unwettable, as by the use of materials and precedures already described. The electrode extends only a short distance into the enclosure and the upper surface of the center glass portion of the header may be substantially flat. The size of the globule of mercury 140 is such that it remains in the position of FIG. 1 when the switch is in upright position. When the switch is tilted the globule assumes the position of FIG. 18*a* bridging the electrode 138 and the metal surface of the cap 134 and/or header 130. Because of the substantially flat glass surface, the switch will be particularly sensitive to a small degree of tilt. The portion of the electrode extending into the enclosure may be mercury-wettable over a part or all of its surface, thus resulting in some surface tension adherence with the globule to make the switch more stable in the open position. The length of the internal portion should be short enough so as not to be engaged by the globule when the switch is in inverted position. If desired, the electrode 138 may be of the cored construction shown in detail in FIG. 5 and previously described in connection therewith.

FIG. 19 shows a single electrode switch offering certain additional features to the switch of FIG. 17 just described. The header 142 in FIG. 18 is somewhat cup-shaped and is provided with a central glass portion 144 having a concave or reverse conical upper surface through which electrode 146 extends. A flat metal cap 148 is welded at its edge to the header to form a sealed enclosure. In order to attain a smaller switch, particularly in the vertical dimension, the globule of conducting metal 150 therein is preferably of mercury with a sufficient amount of an additive such as caesium or potassium to reduce its surface tension and thus also reduce its height. Otherwise the switch of FIG. 19 has interior surfaces which are mercury-unwettable and functions similarly to the switch of FIGS. 18 and 18*a*. The sloping or conical upper surface of the glass center portion 144 of the header reduces the sensitivity of the switch and makes its operation more subject to control than can be attained with a substantially flat surface.

It will be noted that the switches of FIGS. 18 and 19 are in open rather than closed condition when they are oriented in a solid angle about a generally upright position. When such a switch is used for controlling the LED display of an electronic wristwatch as previously discussed, the electrical connection to the watch circuit must be accommodated to this open-circuit condition.

FIGS. 20 and 20*a* relate to another form of dry wall switch using a single electrode passing through the housing. Here, the switch 150 comprises a header 152 having generally the same configuration as that of the switch of FIGS. 9 to 12 except that only a single electrode 154 extends through the center of glass center portion 156 thereof and the shelf-type operation is not used. A cap 158 having a generally reverse conical bottom portion is welded to the header through outer peripheral flanges at 160. A globule 162 of mercury or like materials in the enclosure serves to make contact between the electrode 154 and the inner surface of cap 158 to which a terminal wire may be welded when the switch is in a solid angle about its upright position as shown in FIG. 19. When the switch is tilted outside that angle as in FIG. 20*a*, the contact with the electrode 154 is opened.

As previously noted, my invention is particularly useful for tilt switches of very small size. An an example, I have found that practical switches of the construction illustrated in FIGS. 1 to 3 and FIGS. 7 to 9 can be made with a diameter between 0.180 and 0.250 inch and a height between 0.100 and 0.175 inches. Smaller switches are also believed to be practical when constructed in accordance with my invention.

Although preferred embodiments of the invention have been described in detail, it will be understood that various changes, substitutions, alterations and other detail modifications may be made therein without departing from the spirit and scope of the invention as defined in the appended claims.

What is claimed is:

1. A tilt switch comprising:

a gravity responsive conductive ball;

a housing defining an enclosure for said gravity responsive conductive ball;

annular shelf means adjacent one end of said housing;

means defining a depression adjacent said one end of said housing and surrounded by said annular shelf;

contact means including:

at least one switch extending through said housing and exposed at said depression, and at least one additional contact, said gravity responsive conductive ball being freely movable in said enclosure in response to tilting of the switch between a first portion supported, out of contact with said at least one switch contact exposed at said depression, on said annular shelf means against a portion of the housing projecting therebeyond and a second position extending into said depression in contact with said at least one switch contact exposed at said depression and with said at least one additional contact;

said gravity responsive conductive ball being operable to assume said second position only when the switch is oriented within a solid angle including a generally upright position; and said housing comprising:

a header having an inwardly extending flange defining said annular shelf means, a central closure portion of insulating material by which said depression is defined, and an outwardly extending, metal peripheral portion; and a metal cap welded to said peripheral portion of said header to seal the enclosure.

2. The tilt switch according to claim 1 wherein:

said gravity responsive conductive ball comprises mercury; and the interior surfaces of said leader and said cap are unwettable by said gravity responsive conductive ball.

3. The tilt switch according to claim 2 wherein said at least one switch contact extending through said housing and exposed at said depression comprises:

an outer portion of mercury unwettable metal which does not project into said depression; and an inner core portion of mercury wettable material which does project into said depression.

4. The tilt switch according to claim 3 wherein: the tip of said core portion is pointed.

5. The tilt switch of claim 1 in combination with:

a wristwatch housing a battery-powered circuit for illuminating a display means in response to actuation of control means therefor; and means mounting the switch on the wristwatch so as to actuate the display control means when the wristwatch is in a position suitable for viewing the display.

6. A tilt switch according to claim 28 wherein:

said gravity responsive ball is a liquid conductive globule;

said at least one switch contact and said at least one additional contact are comprised of two spaced switch contacts extending through said closure portion of insulating material at a position such that said liquid conductive globule bridges said switch contacts when the switch is within said solid angle including a generally upright position; and said switch contacts being so spaced relative to the size of said globule that the extent of said solid angle over which said globule bridges said contacts is smaller in a plane including said contact than in a plane perpendicular thereto.

* * * * *